United States Patent [19]

Hong

[11] Patent Number: 4,658,114

[45] Date of Patent: Apr. 14, 1987

[54] HEATER AND HOLDER FOR SOFT ROLLER HAIR CURLERS

[76] Inventor: Andrew M. P. Hong, c/o Celestial Electric Mfg., Co., Ltd., Block A&B, 2/F, Acro Ind. Bldg., 19 Yuk Yat Street, Tokwawan, Kowloon, Hong Kong

[21] Appl. No.: 859,838

[22] Filed: May 5, 1986

[51] Int. Cl.[4] ..... H05B 1/00; A45D 2/18; A45D 4/12

[52] U.S. Cl. ..... 219/222; 132/33 R; 132/33 G; 132/39; 219/242; 219/385; 219/521

[58] Field of Search ..... 219/222–226, 219/242, 521, 385; 132/33 R, 33 G, 39–41, 9, 43 R, 43 A

[56] References Cited

U.S. PATENT DOCUMENTS

| | | | |
|---|---|---|---|
| 1,554,800 | 9/1925 | Dodge | 219/242 |
| 1,694,725 | 12/1928 | Tabb | 219/242 |
| 2,262,506 | 11/1941 | Levandowski | 219/242 X |
| 3,410,985 | 11/1968 | Giacchero | 219/242 X |
| 3,585,357 | 6/1971 | Mandell et al. | 219/242 X |
| 3,946,196 | 3/1976 | Waters et al. | 219/521 X |
| 4,298,787 | 11/1981 | Barradas | 219/242 X |
| 4,584,462 | 4/1986 | Morrison | 219/242 X |

*Primary Examiner*—Anthony Bartis
*Attorney, Agent, or Firm*—Alfred E. Miller

[57] ABSTRACT

A heater and holder for soft roller hair curlers includes a base having an openable top cover providing access to a shelf provided with at least one row of spaced holes of a size of to admit a hair curler. Each hole is aligned with an open-ended heat conductive metallic tube extending through a heat conductive metallic plate positioned below the shelf and having spaced top and lower panels with a first section of the tube extending upwardly from the top panel in alignment with the hole and a second section extending downwardly from the lower panel. A flexible electric heating element positioned in the space between the panels in a sinuous pattern heats the tubes and the curler inserted therein. The length of the tube is less than the length of the roller curler so that the opposite ends of the curlers are not heated so as to remain relatively cool whereby the heated curler can be easily handled.

7 Claims, 5 Drawing Figures

HEATER AND HOLDER FOR SOFT ROLLER HAIR CURLERS

The present invention relates to a heater arrangement for hair curlers known as soft rollers.

The heater is arranged in a casing or receptacle for heating and storing the soft rollers in the base structure thereof, while the top is hinged and designed to be flipped open or closed by the user.

The heater of the present invention is more efficient than the heater of the type shown in U.S. Pat. No. 4,298,787, issued Nov. 3, 1981 to Barradas.

It is therefore an object of the present invention to provide a heater arrangement which includes a heat conductive shelf disposed horizontally in a base member, and in which a plurality of cylindrical tubes project from the upper and lower surfaces thereof perpendicular thereto in opposite directions. The length of the heater tubes can be chosen in accordance with the selected length of the hair setting rollers to be heated.

It is the object of the present invention to provide a hair setting roller heater and holder which is compact and easily portable.

The heating wires are connected to the horizontal heating shelf. The heating shelf with heating tubes is mounted in the base member of the holder by means of a plurality of spaced, insulated support members. Heat is supplied to the shelf and the tubes thereon by means of electrical resistance wire. It is wound in a special manner, in order to maximize the heat being transferred to the cylindrical heating tubes.

It is the further object of the present invention to provide a heating device for hair curlers of the roller type in which the heated tubes transfer the heat therefrom to the median portions of the hair rollers so that there is a high heat concentration in the central portions of the hair rollers, while the ends thereof are relatively cool to the touch so that the user can handle and use the heated hair rollers without burning one's fingers.

It is another object of the present invention to provide electrical resistance heating wire which is wound in a sinuous manner about rows of heating tubes in order to effect the most concentrated heating pattern for the central portions of the heating tubes. It should be apparent that the electrical energy supplied to the electrical resistance wires is provided by an external alternating current source. The heating tubes are designed as hollow, open-ended metallic tubes, and are preferably fabricated of aluminum.

In order that the invention will be more clearly understood, it will now be disclosed in greater detail with reference to the accompanying drawings, in which.

Figure 1:
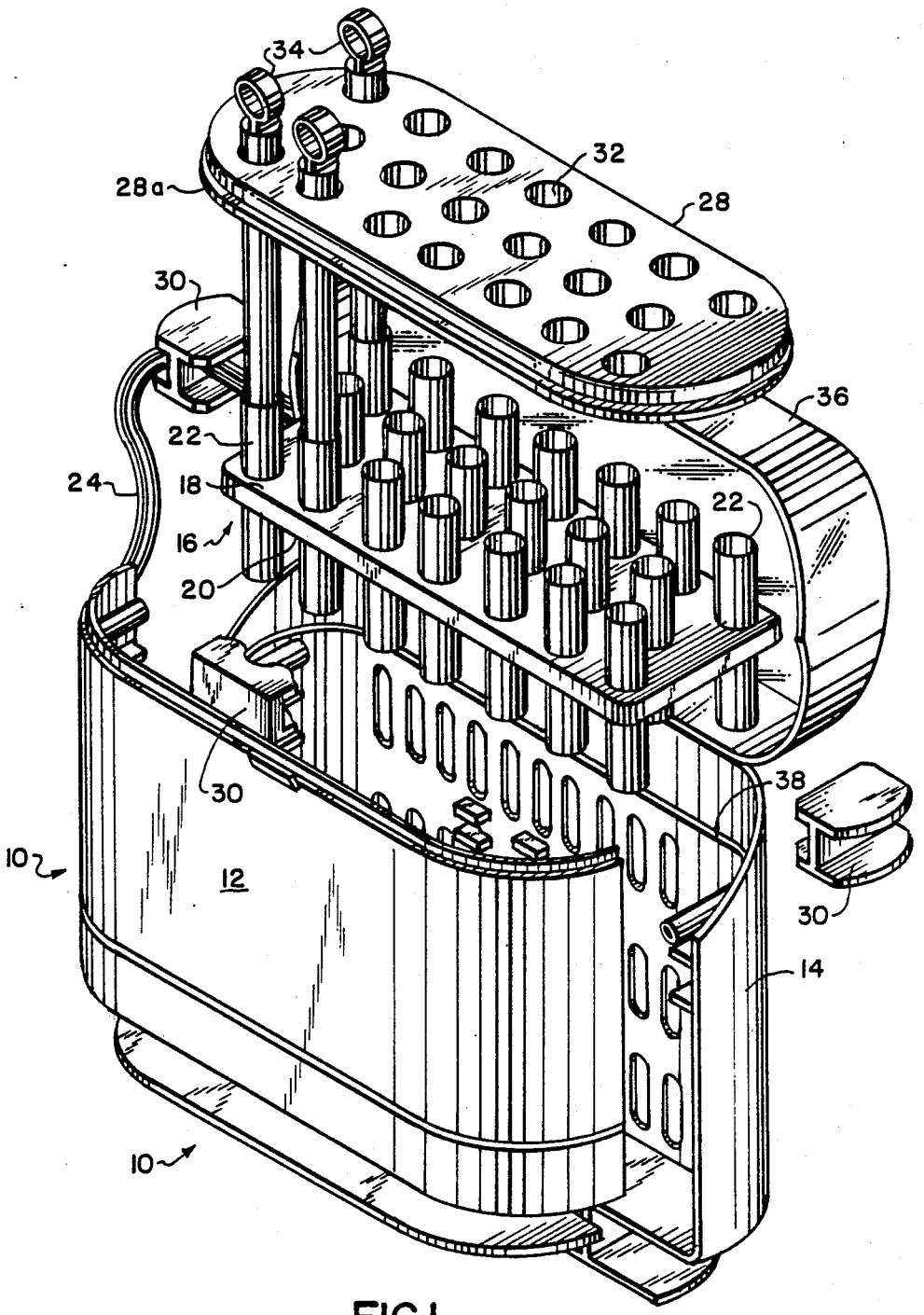
FIG. 1 is a perspective, exploded view of a heating device for flexible roller hair curlers together with a casing therefor, as constructed and arranged in accordance with the teachings of my invention.
Figure 3:
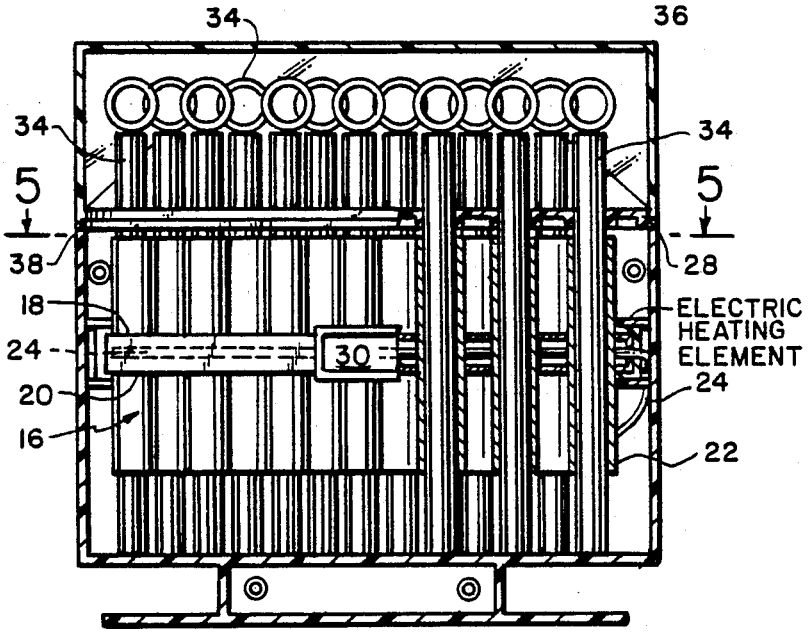
FIG. 3 is a sectional view of the heater, casing and cover together with the plurality of flexible hair rollers inserted in the heating tubes thereof.
Figure 4:
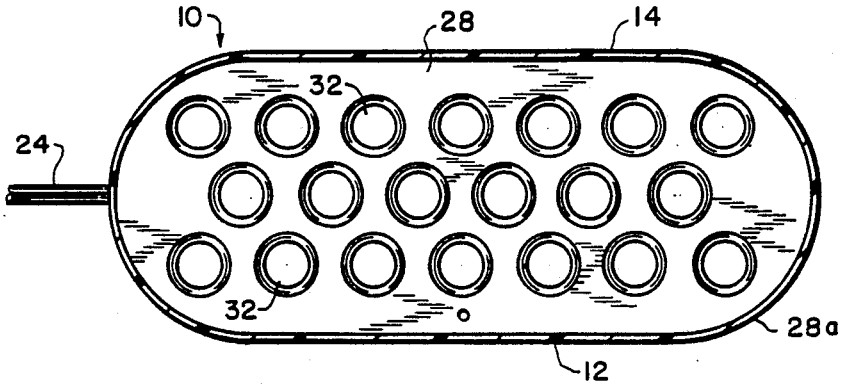
FIG. 4 is a top plan view taken along the lines of 4—4 of FIG. 2, with a transparent cover removed.
Figure 5:
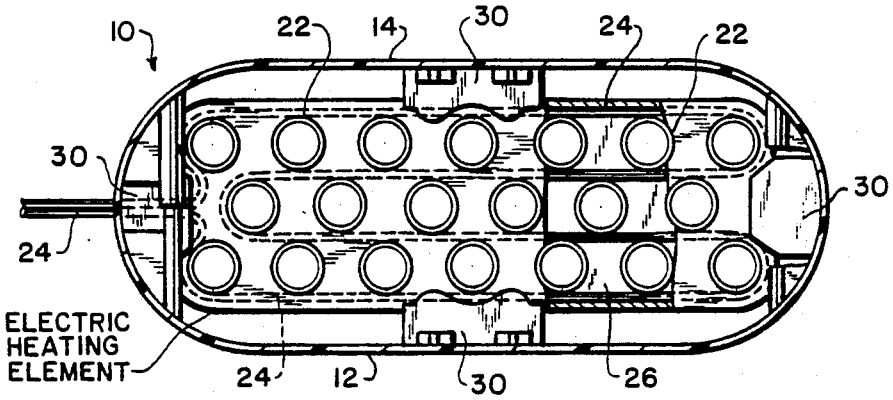
FIG. 5 is a sectional view taken along the lines 5—5 of FIG. 3, with part of the construction broken away for purposes of clarity.

Referring more particularly to the drawings, as illustrated in FIG. 1, the apparatus constitutes a bipartite base unit referred to generally by the numeral 10 and having identical parts 12 and 14 which are fitted and secured together, as shown in FIGS. 4 and 5. Mounted in the median section of base parts 12 and 14 is a shelf referred to generally by the reference numeral 16 which is provided with a pair of spaced upper and lower plates 18 and 20 respectively. The positioning of the shelf within the base member of the assembly is clearly shown in the sectional view of FIG. 3. The shelf 16 is fabricated of a heat conductive material, such as aluminum, and is also provided with a plurality of rows of metallic tubular members or tubes 22 which project both upwardly and downwardly through the shelf 16. It should be evident that the tubes 22 are in heat conducting relationship with the plates 18 and 20 of the shelf 16.

Electrical resistance wires 24 are shown which enter the space 26 between the heat-conductive plates 18 and 20. As seen in FIG. 5, the electrical resistance heating wires 24 are wound in a sinuous pattern around rows of the heating tubes 22 in order to effect the most concentrated heating pattern for said heating tubes 22. Consequently, the heat generated by electrical resistance wires 24 is transferred to both the upper and lower parts of cylindrical tubes 22 to thereby concentrate the heat therein. The shelf 16 is mounted in the median portion of the base member 10 by means of insulating supports 30, each of which on one side engages the shelf 16 and on the opposite side thereof is removably secured to the respective parts 12 and 14 of base member 10. Accordingly, the tubes 22, as well as the heat conductive shelf 16 are removed from engagement with the base member, therefore the latter will not be hot to the touch.

Figure 2:
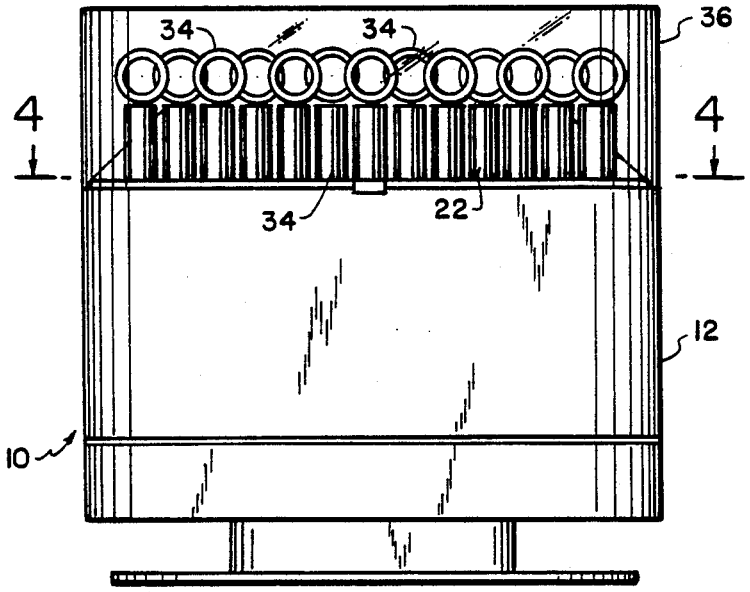
FIG. 2 is a front elevation thereof, showing the casing with a transparent cover, in its closed condition.

A support shelf 28 preferably fabricated of a thermoplastic material is provided with a plurality of holes 32. The shelf 28 is mounted at the top of the base member 10, as clearly seen in FIG. 3, whereby the holes 32 are aligned with the cylindrical tubes 22 so that the soft flexible hair curlers 34 may be inserted through the holes 32 and its aligned heating tubes 22, as seen in FIGS. 1–3. The rollers are preferably of the type shown and described in U.S. Pat. No. 4,572,221, issued Feb. 25, 1986, to Barradas. It should be evident that the length of each cylindrical tube 22 which has both upper and lower sections can be selected so that only the median part of the hair curler is heated to a high temperature, while the ends thereof remain cool to the touch. Consequently, the ends of the hair curlers remain unheated to any great extent so that the user can handle and use the heated hair roller curler without burning one's fingers. It should also be apparent that the length of the tubes 22 can be increased or decreased depending upon the length of the hair rollers intended to be used in setting one's hair.

The base member 10 of the present appliance additionally includes a hinged top or cover 36, preferably of a clear plastic. This cover is shown in its closed position in FIG. 2. The present appliance also functions as a simple holder and storage device for soft roller hair curlers without utilizing the heating function of the cylindrical tubes 22.

It should be apparent that the present heater permits the hair curler rollers to be heated on the outside instead of internally so that the maximum effectiveness of the heat generated by the heating tubes 22 can be realized especially since the hair is curled around the exterior hot surfaces of the hair curlers. Moreover, as stated hereinabove, the heating tubes can be lengthened or shortened to accomodate the various lengths of hair curlers depending upon the use intended.

While the invention has been disclosed and described with reference to a single embodiment, it is apparent that variations and modifications may be made therein, and it is therefore intended to cover such variations and modifications as falls within the true spirit and scope of the invention as set forth in the following claims.

I claim:

1. In a holder for soft roller hair curlers having a base having an open top closed by an openable cover, a shelf in said base accessible through said open top and provided with a plurality of holes wherein the hair curlers are adapted to be inserted therethrough, the improvement comprising a heat-conductive plate having spaced top and lower panels, a plurality of open-ended heat conductive hollow heating tubes each having a first section with an open upper end in alignment with a different one of the holes in said shelf and extending upwardly from one panel and a second section extending downwardly from the other panel and in alignment with each other, a flexible electric heating element in said space between said panels and arranged to heat said heating tubes, and the roller hair curlers being insertible through the holes of said shelf into said hollow heating tubes and wherein the combined length of said first and second sections of each heating tube is less than the length of the curler to be heated so that the opposite ends of said roller hair curlers are not heated.

2. In a holder for soft roller hair curlers as claimed in claim 1 wherein said heating tubes are arranged in parallel rows and said flexible heating element comprises wires that are wound around said rows in a sinuous pattern.

3. In a holder for soft roller hair curlers as claimed in claim 2 wherein said wires are electrical resistance wires.

4. In a holder for soft roller hair curlers as claimed in claim 2 wherein said wires are in heat-conducting engagement with the junction of said first and second sections of each of said heating tubes.

5. In a holder for soft roller hair curlers as claimed in claim 1 further comprising at least one insulating support for mounting said heat-conductive metal plate in said base below said shelf.

6. A holder and heater for soft roller hair curlers comprising a base having an open top closed by an openable cover, a shelf in said base provided with a plurality of holes wherein the hair curlers are adapted to be inserted therethrough, a heat conductive plate positioned below said shelf and having spaced top and lower panels, a plurality of open-ended heat-conductive one-piece hollow heating tubes extending through said plate and each having a section extending upwardly from the top panel and a section extending downwardly from the lower panel, a flexible electric heating element in said space between said panels and arranged to heat said heating tubes, and the open upper end of each tube being aligned with a different hole in said shelf so that a hair curling roller can be inserted through the shelf hole into the tube for heating.

7. In a holder and heater for soft roller hair curlers as claimed in claim 6 wherein said cover is transparent plastic and is hinged to said base to provide ready access to the roller hair curlers projecting upwardly from the holes in said shelf.

* * * * *